United States Patent [19]

Cease

[11] 4,104,902

[45] Aug. 8, 1978

[54] FERRULE FORMING ASSEMBLY

[75] Inventor: James W. Cease, Phillipsburg, N.J.

[73] Assignee: Robert H. Fine, Milford, N.J.

[21] Appl. No.: 810,957

[22] Filed: Jun. 29, 1977

[51] Int. Cl.[2] ..... B21D 41/02

[52] U.S. Cl. ..... 72/117; 72/125; 72/318

[58] Field of Search ..... 72/112, 115, 116, 117, 72/125, 316, 317, 318

[56] References Cited

U.S. PATENT DOCUMENTS

| | | | |
|---|---|---|---|
| 1,372,197 | 3/1921 | Rudolph | 72/117 |
| 2,100,939 | 11/1937 | Brenner | 72/318 |
| 3,415,100 | 12/1968 | Britts | 72/317 |
| 3,575,033 | 4/1971 | Meyer | 72/317 |
| 4,047,415 | 9/1977 | Crane et al. | 72/125 |

*Primary Examiner*—Lowell A. Larson
*Attorney, Agent, or Firm*—Daniel H. Bobis

[57] ABSTRACT

An assembly for forming a ferrule on a tube, pipe, conduit or the like has a housing, a transverse bore extending through the housing with a medially disposed annular die surface formed therein, the section of the bore facing the annular die surface is threaded to receive a ferrule forming element which can be threaded towards and away from the annular die surface and will form a cavity with the annular die surface for holding lubricant therein when the tube is positioned in the transverse bore so that it extends into the threaded section of the bore, the section of the bore on the side remote from the annular die surface has a plurality of annular channels which form a labyrinth seal with the tube in assembled position in the transverse bore and act to hold the tube and to control the leakage of lubricant therefrom. The ferrule forming element has a centering pin which prevents the tube, pipe, conduit or the like from collapsing during the formation of the ferrule, and is shaped and formed for engagement with the tube and with a contoured end so that threading of the ferrule forming element towards the annular die surface in the presence of the lubricant will cause the tube material to form into the desired shaped ferrule thereon.

The ferrule forming device may have a depth gauge formed thereon to position the end of the tube, pipe, conduit or the like; on which the ferrule is to be formed; in the threaded section of the transverse bore.

4 Claims, 7 Drawing Figures

FERRULE FORMING ASSEMBLY

BACKGROUND OF THE INVENTION

In the plumbing art it is well known to provide a seal at the point where a tube is connected to a threaded fitting by utilizing an independent brass ferrule having an inner diameter with relatively close tolerances which permits the brass ferrule to have a sliding fit about the tube and to be pressed and squeezed to form the desired seal as the threaded connection is being made.

Various attempts have been made in the prior art to connect a ferrule or to form a ferrule on the outside of the tube, pipe or conduit being connected to the threaded fitting such as is shown in U.S. Pat. Nos. 2,447,909 and 3,610,016.

The prior art devices essentially provide complex and expensive machines for accomplishing these results and in the case of the machinery for forming ferrules on the tubing itself, the mechanism relied on either mechanical or hydraulic expands the tubes, pipes or conduits from the inner diameter or inner walls thereof so that the outer walls conform to a mold or die form of the desired ferrule shape to be provided on the outer surface of the tube, pipe or conduit.

The present invention provides a relatively simple device for accomplishing the same result in which the tube is held in a longitudinal line and the end is pressed or squeezed in the presence of a suitable lubricant so as to form itself into the shape or contour of a split die, a portion of which is fixed and a portion of which is movable to establish the desired shape of the ferrule to be formed on the outside of the tube. The lubricant prevents the dies from cutting the tube, pipe, conduit or the like and aids the formation of the ferrule thereon.

SUMMARY OF THE INVENTION

Thus the present invention covers an assembly for forming a ferrule on a tube, pipe, conduit and the like element which includes, a housing having at least one transverse bore therethrough for receiving a predetermined length of said tube and the like elements therein, an annular die surface formed in the medial section of the transverse bore, a threaded section on one side of the annular die surface and a labyrinth seal section on the other side of the annular die surface, a ferrule forming element threadibly connected in said threaded section for movement towards and away from the annular die surface and initially spaced from said annular die surface to permit a lubricant to fill the threaded section in the space about the tube, said ferrule forming element having a sized cavity operatively connected to the tube and the like elements therein in said initial position, and provided with a mating contoured end facing the annular die surface to provide the desired ferrule shape on the tube and the like elements placed in the transverse bore when the ferrule forming element is threaded into engagement with the annular die surface.

Additionally the assembly for forming a ferrule as above described having a depth gauge thereon for use in setting the predetermined length of said tube and the like elements disposed in the transverse bore.

Accordingly it is an object of the present invention to provide an improved assembly for forming a ferrule on the outside of a tube, pipe, conduit and the like element.

It is another object of the present invention to provide a relatively small portable and cheap device or assembly for forming the ferrule on the outside of a tube, pipe, conduit and the like element particularly adapted for use in the reparir and installation of piping systems.

Other objects and advantages will become apparent from the details of the structure and operation of a preferred form of the present invention more fully described and claimed with reference to the accompanying drawings in which:

Figure 1:
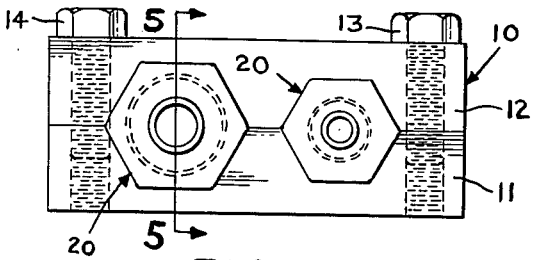
FIG. 1 is a side view of a ferrule forming assembly in accordance with the present invention.
Figure 2:
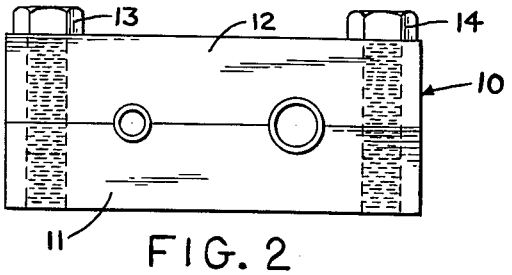
FIG. 2 is a back view of the ferrule forming assembly shown in FIG. 1.
Figure 3:
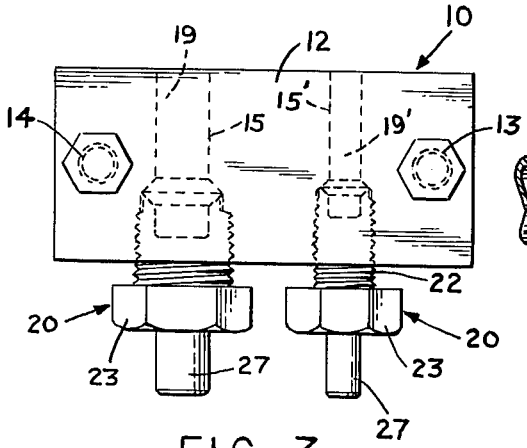
FIG. 3 is a top plan view of the ferrule forming assembly shown in FIG. 1 with two sized ferrule forming elements and the transverse bore associated therewith shown in phantomized form.

Referring to the drawings FIGS. 1 to 3 show that the ferrule forming assembly generally designated 10 in accordance with the present invention includes a lower housing section 11 and an upper housing section 12 which are connected in tight engagement by spaced threaded elements as at 13 and 14.

Ferrule forming assembly 10 is generally elongated and in the illustrated form of the invention is rectangular in cross-section both in the length and the width thereof as is shown in the FIGURES of the drawings. Due to the pressures exerted in the formation of a ferrule on the tube, pipe, conduit and the like element as is more fully described below, the housing sections 11 and 12 are preferably made of a relatively strong material such as a steel alloy. It will be understood however that any material of equal strength thereto can be utilized without the departing from the scope of the present invention.

Figure 4:
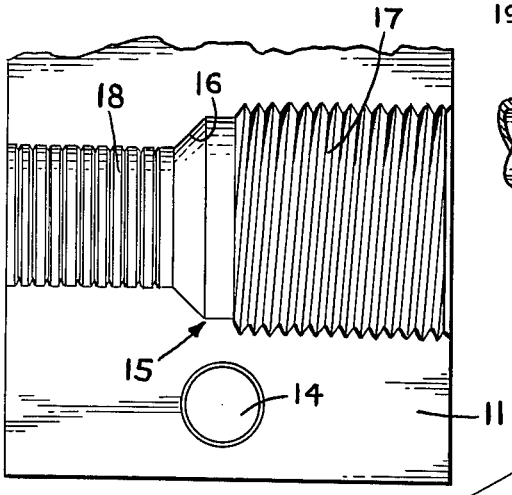
FIG. 4 is a top plan view of the lower half of a fragment of the housing of the ferrule forming assembly shown in FIG. 1 showing the lower half of one of the transverse bores.

Lower housing section 11 and upper housing section 12 are machined so that matching halves of transverse bores as at 15 and 15' are formed therein when the housing sections are joined together as is shown in FIGS. 3 and 4 of the drawings.

In FIG. 3 two transverse bores each having different diameters are illustrated which those skilled in the art will at once recognize as necessary to accomodate tubes, pipes, conduits and the like elements of different outer diameters.

It is known that tubes, pipes, conduits and the like elements are stocked in various standard outer diameter sizes and that these stock sizes vary within certain recognized tolerances. Therefore in order to accomodate these various stock sizes the ferrule forming assembly will have one or more transverse bores to accomodate the given size of tubes, pipes, conduits and the like elements on which it is desired to form a ferrule. Thus it will be understood by those skilled in the art that the ferrule forming assembly can be elongated to provide for any number of transverse bores or alternatively a plurality of ferrule forming assemblies each with a single sized transverse bore for accomodating a given size of tube, pipe, conduit and the like element may also be used.

The transverse bores 15 and 15' except as to the diameter size which they can accomodate are identical in construction.

Figure 7:
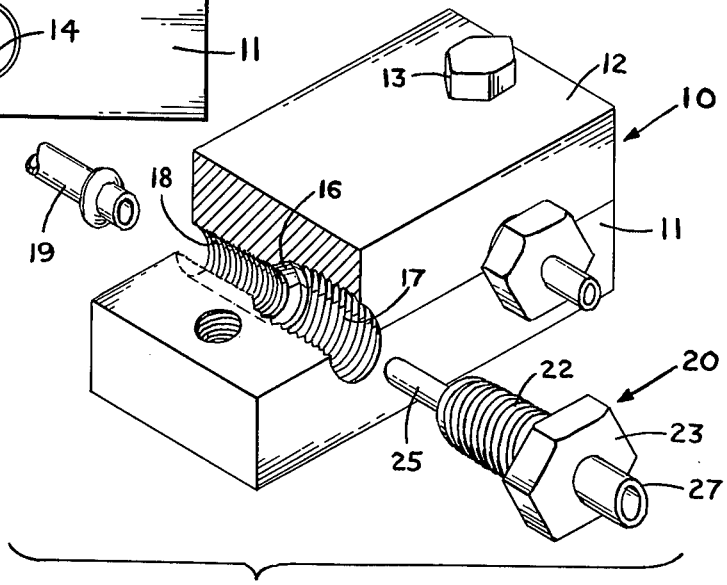
FIG. 7 is a perspective view partly broken away with the ferrule forming assembly and tube illustrated in FIG. 6 shown in exploded form.

Thus by reference to FIGS. 4 and 7 of the drawings each transverse bore 15 and 15' has one half of an annular die surface 16 formed perpendicular to the longitudinal axis of the bore in the respective medial section thereof. The section of the transverse bore facing the annular die surface 16 is threaded as at 17 and on the opposite side of the annular die surface 16 a plurality of annular channels 18 are formed. The annular channels 18 form labyrinth seals with the outer diameter of a tube, pipe, conduit or the like element generally designated 19 in the Figures that is positioned in the transverse bore for having a ferrule formed thereon. When the respective housing sections 11 and 12 are joined together, the labyringth seals hold the tube, pipe, conduit or the like element in position and also act to prevent or preferably to limit leakage of lubricant generally designated LUBE in FIG. 5 from the threaded section 17 of the transverse bore along the exterior of the tube when the ferrule forming assembly is operated to form a ferrule thereon.

Figure 5:
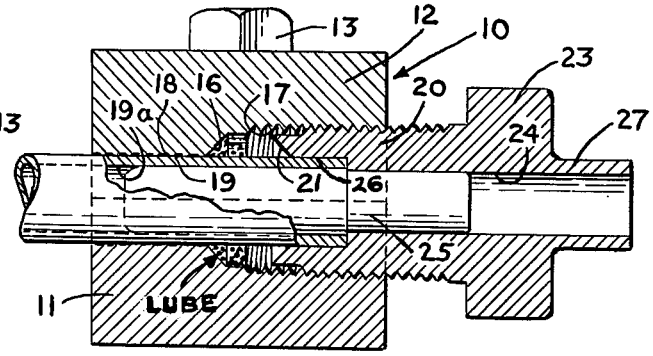
FIG. 5 is a cross-section taken on line 5—5 showing a tube in assembled position in one of the transverse bores before the ferrule has been formed thereon.
Figure 6:
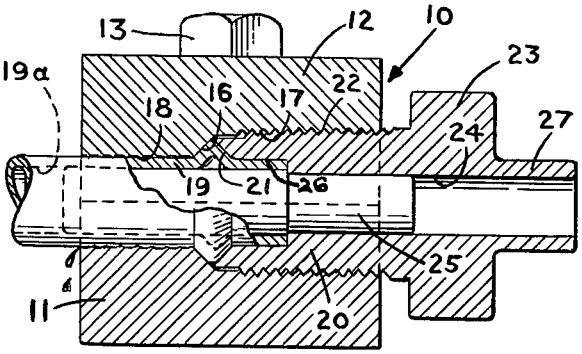
FIG. 6 is the same cross-section as FIG. 5 showing the tube with the ferrule formed thereon.

Threaded section 17 of the transverse bores 15 and 15' receives a ferrule forming element 20 therein which can be threaded towards and away from the annular die surface 16 in the manner illustrated in FIGS. 5 and 6 of the drawings.

This action being done in the presence of the lubricant which initially fills the space between the fixed annular die surface 16 and the mating contoured end 21 of the ferrule forming element 20 when it is in the initial position as shown in FIG. 5 of the drawings.

In effect this construction provides a split mold for the shape or contour of the ferrule to be formed on the outside of the tube 19, one portion represented by the annular die surface 16 being fixed and the other represented by the contoured end 21 on the ferrule forming element 20 which is movable relative thereto.

FERRULE FORMING ELEMENT

Ferrule forming element 20 has an elongated substantially cylindrical shape and is threaded as at 22 on a portion of the outer section thereof so that it can be movably mounted in the respective threaded section 17 of the transverse bores 15 and 15'.

At the end thereof opposite from the contoured mating end 21 it is provided with a hexagonally shaped head 23 which is sized to receive any conventional wrench or other device for rotating the ferrule forming element 20 into and out of the respective threaded sections 17 of the transverse bores 15 and 15'.

The ferrule forming element 20 has a bore 24 extending end to end therethrough in the longitudinal center line of the ferrule forming element 20 in which a centering pin 25 is mounted as is shown in FIGS. 5 and 6 of the drawings.

The centering pin 25 prevents the wall of the tube, pipe, conduit and the like element on which the ferrule is being formed from collapsing.

Centering pin 25 extends beyond the contoured mating end 21 of the ferrule forming element 20 a substantial distance and is sized so that it will lie in snug engagement with and extend into the bore 19*a* of the tube 19 on which the ferrule is to be formed. In effect the center pin 25 will have a length to permit it to extend into the bore a distance beyond the annular die surface 16 approximately $\frac{1}{3}$ to $\frac{1}{2}$ the length of the labyrinth section 18 of the transverse bores 15 or 15' all of which is shown in FIGS. 5 and 6 of the drawings.

In addition to the center pin 25 the ferrule forming element is provided with a counterbore 26 which extends inwardly from the contoured mating end 21 a limited length sufficient to hold and engage one end position of the outer surface of the tube, pipe, conduit or the like element into which the center pin 25 extends so that the center pin 25 and the counterbore 26 act as a jacket about this one end and permit the required end pressures to be exerted on the tube, pipe, conduit or the like element and the and the center pin 25 prevents the element 19 from collapsing as the ferrule is being formed thereon.

In order to position the tube, pipe, conduit or the like element in the transverse bores 15 or 15' so that the ferrules can be properly formed thereon, it is necessary to determine empirically or otherwise the pressures that can be exerted on the outside of the particular tube on which the ferrule is to be formed and to set the end or section of the tube, pipe, conduit or the like element so that it can be moved or pressed by the ferrule forming element 20 to form the shaped ferrule at the desired point thereon. For this purpose a relatively simple depth gauge or measuring device 27 is provided on each of the ferrule forming elements 20 which depth gauge 27 is connected to the outer end of the ferrule forming element 20 extending outwardly in the longitudinal centerline thereof as is shown in FIGS. 5, 6 and 7 of the drawings.

The diameter of the depth gauge or measuring element 27 will be such that it fits easily into the associated transverse bore 15 or 15' in which the ferrule forming device 20 will be mounted.

OPERATION OF THE FERRULE FORMING ASSEMBLY

In the use of the ferrule forming assembly 10 the shape of the ferrule to be formed or established on a given tube is provided by shaping the fixed annular die surface 16 and the movable contoured mating end 21 of the ferrule forming element 20.

The tube, pipe, conduit or the like element on which the ferrule is to be formed is selected and passed into the opening of the labyrinth end 18 of the proper sized transverse bore 15 or 15' and then extended through the labyrinth end 18 passed the annular die surface 16 into the threaded section 17 of the selected transverse bore.

In order to properly position the end of the tube 19 in the threaded section the ferrule forming element 20 is turned upside down and the depth gauge or measuring device 27 is inserted into the threaded section 17 of the given transverse bore until the ferrule forming element shoulders against the side of the ferrule forming assembly having the opening for the threaded section 17. When the ferrule forming element 20 is held in this position the tube 19 can be moved into the transverse section until it abuts against the end of the depth gauge or measuring device 27 at which point the upper and lower housing can be tightened into engagement with the tube, pipe, conduit or the like element in this position by means of the threaded member 13 and 14.

The ferrule forming element is then removed and the threaded section is filled with lubricant up to the level of the end of the tube, pipe, conduit or the like element 19 in the threaded section of the given transverse bore. The lubricant is preferably a high density type such as heavy or thick oil, grease or a wax.

Thereafter the ferrule forming element is threadibly connected into the threaded section 17 of the given transverse bore and threaded inwardly until it is in the initial position in abutment with the end of the tube, pipe, conduit or the like element 19 as is shown in FIG. 5 of the drawings.

In order to form the ferrule on the tube, pipe, conduit or the like element 19 a wrench is applied to the hexagonal head 26 and the ferrule forming element is turned so that it advances into the threaded section and this is continued until the ferrule forming element is brought into engagement with the end of the annular die surface 16 as is shown in FIG. 6 of the drawings.

Due to the counterbore 26 and the centering pin 25 this pressing movement of the ferrule forming element 20 will cause the tube, pipe, conduit or the like element 19 to expand in the only space available, namely into the contoured or shaped portion defined by the annular die surface 16 and the contoured mating end 21 of the ferrule forming element.

Since this pressing action occurs in the presence of the lubricant metal to metal contact is prevented, binding and cutting of the tube, pipe, etc. by the associated elements of the ferrule forming assembly is prevented, and a well defined ferrule is effectively formed on the outside of the tube, pipe, conduit or like element as is shown and illustrated in FIG. 7 of the drawings.

The centering device 25 on the ferrule forming element 20 is removable and replaceable by other and different centering members and the size of the centering member will be a function of the inner diameter tube, pipe, conduit or like device on which the ferrule is being formed.

It is imperative that the laybrinth seal formed by the annular channels 18 in the respective bores 15 or 15' shall not only be capable of sealing against the leakage of lubricant from the associated threaded section of the given transverse bore but additionally in assembled position it must be able to hold the given tube to prevent slippage thereof as the ferrule is being formed thereon. The longitudinal depth of the counterbore from the point where the inner aspect of the mating seat begins must be sized depending on the length of the depth gauge or measuring device 27 on the ferrule forming element 20 as a function of the width of the ferrule to be formed.

The ferrule itself can be provided with any shape including round, angled, flat or convuluted depending on the shape of the annular die surface 16 and the contoured mating end 21 of the ferrule forming element.

Thus a relatively simple cheap and easily utilized ferrule forming assembly has been described above.

Other objects and advantages of the invention including the basic design and the nature of the improvements thereon will appear from the following description taken in conjunction with the accompanying drawings, in which:

What is claimed is:

1. An assembly for forming a ferrule on a tubular member comprising, a. housing means, b. at least one sized transverse bore extending end to end in said housing and having at least one opening in the side of said housing to permit the tubular member to be inserted therethrough a predetermined distance so as to position the same in the transverse bore as a function of the position where the ferrule will be formed thereon, c. said transverse bore has a first sized section to hold the tubular member from slipping in assembled position for forming the ferrule thereon, a second counter-bored section in alignment with said first sized section, and a fixed contoured annular die surface formed medially in said transverse bore between the first sized section and the second counter-bored section, d. said second counter-bored section threaded for a portion of the length thereof a spaced distance from the fixed annular die surface, e. a ferrule forming element having, an inner end, an outer end, and threaded means thereon for threadably connecting the same in the threaded section of said second counterbored section to permit movement thereof in the transverse bore towards and away from the fixed annular die surface, and said ferrule forming element in assembled position in said second counter-bored section to define a lubricant space adjacent the fixed annular die surface, f. said sized section having a plurality of spaced annular channels to provide a labyrinth seal on the side of the fixed annular die surface remote from the lubricant space to limit leakage of the lubricant from the transverse bore during formation of the ferrule on the tubular member, g. said ferrule forming element having a contoured mating die surface at the inner end thereof to coact with the fixed annular die surface on movement of the ferrule forming element so as to form the shaped ferrule on the tubular member, and h. means at the inner end of the ferrule forming element for engaging the end, the outer surface, and the inner bore of the tubular member to permit uniform force to be exerted on the end of the tubular member during formation of the ferrule thereon.

2. In an assembly for forming a ferrule on a tubular member as claimed in claim 1 wherein said means at the inner end of the ferrule forming element includes, a. a centering pin connected in the longitudinal axis of the ferrule forming element and disposed to engage the inner bore of the tubular member during the formation of the ferrule thereon, and b. said centering pin having a length to extend into the inner bore of the tubular member at least beyond the position where the ferrule is being formed on said tubular member.

3. In an assembly for forming a ferrule on a tubular member as claimed in claim 1 wherein said means at the inner end of the ferrule forming element includes, a. a bore in the inner end of the ferrule forming element radially inward from the contoured mating die surface having a diameter substantially similar to the outer diameter of the tubular member and extending longitudinally from the inner end a predetermined distance, and b. a centering pin connected in the longitudinal axis of the ferrule forming element and disposed to extend through said bore and beyond the contoured mating die surface so as to form a space between the centering pin and the bore for receiving the end of the tubular member therein during the formation of the ferrule, and c. said centering pin having a length to extend into the inner bore of the tubular element to a point at least beyond the position where the ferrule will be formed thereon.

4. In an assembly for forming a ferrule on a tubular member as Claimed in claim 1 wherein the ferrule forming element has a depth gauge formed on the outer end thereof which extends a predetermined distance outward in the longitudinal axis of the ferrule forming element.

* * * * *